US008936156B1

(12) United States Patent
Tschantz et al.

(10) Patent No.: US 8,936,156 B1
(45) Date of Patent: Jan. 20, 2015

(54) INFLATABLE PACKAGING CUSHION WITH PRODUCT SUSPENSION POCKET

(71) Applicants: Michell C. Tschantz, Newtown, CT (US); Carmine V. Caparaso, Jr., Monroe, CT (US)

(72) Inventors: Michell C. Tschantz, Newtown, CT (US); Carmine V. Caparaso, Jr., Monroe, CT (US)

(73) Assignee: Inflatable Packaging, Inc., Newton, CT (US)

( * ) Notice: Subject to any disclaimer, the term of this patent is extended or adjusted under 35 U.S.C. 154(b) by 0 days.

(21) Appl. No.: 13/838,122

(22) Filed: Mar. 15, 2013

Related U.S. Application Data

(60) Provisional application No. 61/686,507, filed on Apr. 5, 2012.

(51) Int. Cl.
*B65D 85/00* (2006.01)
*B65D 81/05* (2006.01)

(52) U.S. Cl.
CPC ..... *B65D 81/052* (2013.01)
USPC ..... 206/522

(58) Field of Classification Search
USPC ..... 206/522, 521; 383/3
See application file for complete search history.

(56) References Cited

U.S. PATENT DOCUMENTS 5,826,723 A * 10/1998 Jaszai ..... 206/522
6,629,777 B2 * 10/2003 Tanaka et al. ..... 383/3
7,533,772 B2 * 5/2009 Yoshifusa et al. ..... 206/522
2005/0103676 A1 * 5/2005 Lee ..... 206/522
2005/0109656 A1 * 5/2005 Ishizaki ..... 206/522
2006/0191817 A1 * 8/2006 Nishi et al. ..... 206/522
2006/0272288 A1 * 12/2006 Kannankeril ..... 53/403
2007/0090013 A1 * 4/2007 Yoshifusa et al. ..... 206/522
2008/0107362 A1 * 5/2008 Yoshifusa ..... 383/3
2008/0197041 A1 * 8/2008 Jian ..... 206/522
2008/0313996 A1 * 12/2008 Liao et al. ..... 53/405
2009/0050509 A1 * 2/2009 Liao et al. ..... 206/522
2009/0050510 A1 * 2/2009 Kojima et al. ..... 206/522
2009/0127153 A1 * 5/2009 Kim ..... 206/522
2009/0188830 A1 * 7/2009 Liao et al. ..... 206/522
2010/0072103 A1 * 3/2010 Watanabe et al. ..... 206/522
2010/0282824 A1 * 11/2010 Kannankeril et al. ..... 229/68.1
2011/0049001 A1 * 3/2011 Won ..... 206/522
2011/0192121 A1 * 8/2011 Kannankeril et al. ..... 53/473
2011/0226657 A1 * 9/2011 Zhang et al. ..... 206/522
2011/0233101 A1 * 9/2011 Baines ..... 206/522
2012/0067760 A1 * 3/2012 Tschantz et al. ..... 206/522
2012/0097568 A1 * 4/2012 Liao et al. ..... 206/522
2013/0313152 A1 * 11/2013 Liao et al. ..... 206/522

* cited by examiner

*Primary Examiner* — Jacob K Ackun
(74) *Attorney, Agent, or Firm* — Ware, Fressola, Maguire & Barber LLP

(57) ABSTRACT

An inflatable packaging cushion is made of thermoplastic sheet material connected by seams and spot seams and has a product barrier formed by a plurality of adjacent inflatable product barrier tubes forming a product barrier, a pocket panel secured to the product barrier and extending thereacross to a product pocket for receiving a product, and pillar tube extensions of the product barrier tubes forming bulkhead end walls foldable to extend upwardly from the product barrier beyond the product pocket. The cushion and product are inserted in a carton, and the end walls suspend the product. Distal end flaps are also provide opposite the product barrier and product.

8 Claims, 8 Drawing Sheets

INFLATABLE PACKAGING CUSHION WITH PRODUCT SUSPENSION POCKET

RELATED APPLICATION

This application claims benefit of priority to our U.S. Provisional Application Ser. No. 61/686,507 filed Apr. 5, 2012.

FIELD OF THE INVENTION

The invention herein relates to an inflatable packaging cushion with a pocket for receiving a product, the inflatable packaging cushion and product received in a carton and suspending and cushioning the product therein.

BACKGROUND OF THE INVENTION

Inflatable packaging cushions for cushioning products in cartons are known in the art as a substitute for foam pellets, air pillows, fitted and unfitted foam blocks and corrugated support structures.

Foam pellets are placed in cartons surrounding a product to fill voids and separate the product from the walls of the carton and to cushion the product. Foam pellets have disadvantages in that they take a substantial amount of shipping and storage space to make them available at the point of use, and are labor intensive to achieve proper placement and cushioning of the product within its carton. They are also difficult to dispose of after use, and are difficult to recycle. They require substantial amount of raw materials and cost to fabricate and transport.

Individual, small air pillows are often used in place of foam pellets to fill voids in cartons, but are also difficult to place operatively for full protection, and are generally not used for products that require a high level of protection and reliability in their packaging.

Foam blocks that are shaped to accommodate a product and to fit snuggly in cartons while supporting the product are also popular. However, they suffer many of the same disadvantages as foam pellets, in that they are expensive to fabricate, occupy substantial amount of space in shipping to the point of use and in inventory prior to use, and are relatively labor intensive to place on a product. They are also bulky and difficult to dispose of, both in the first at the point of unpacking and in recycling.

Corrugated support structures have also been used to support a product within a carton, but are relatively expensive, and are also labor intensive to install on the product and fit into a carton, and may not provide an appropriate level of cushioning or vibration protection. When combined with thermoplastic suspension panels, they are not easily recycled.

There have been many custom inflatable packaging cushions designed and used with particular products. One such example is found in U.S. Pat. No. 7,584,848, which discloses a generally clam-shaped inflatable packaging cushion that accepts products such as television set top boxes. Although this and other such prior inflatable packaging cushions provide good protection for the product, they generally occupy a substantial volume which requires the use of large cartons and results in higher shipping costs, and often designed for a product or product box of a specific size, which limits their general usefulness.

Accordingly, there is a need for improved packaging cushions.

SUMMARY OF THE INVENTION

It is a principal object of the invention herein to provide an inflatable packaging cushion for protecting products in cartons.

It is an additional object of the invention herein to provide an inflatable packaging cushion for protecting products in cartons that minimizes the required volume of the carton.

It is a further object of the invention herein to provide an inflatable packaging cushion for protecting products in cartons that is adaptable to a plurality of products.

It is also an object of the invention herein to provide an inflatable packaging cushion for protecting products in cartons wherein the inflatable packaging cushion is adapted for easy loading and unloading of the product.

It is another object of the invention herein to provide a combination of an inflatable packaging cushion for protecting products in cartons and a carton for receiving the inflatable packaging cushion and product.

In carrying out the invention herein, an inflatable packaging cushion is provided having a product barrier having first and second sides and first and second ends, the present barrier formed by a plurality of adjacent elongated parallel connected inflatable product barrier tubes. At least inflatable tubes form first and second side spacers respectively positioned and preferably along each of the first and second sides of the product barrier. A pocket panel has first and second side edges, the first pocket panel side edge secured along the first side of the product barrier, and the second product panel side edge secured along the second side of the product barrier. The pocket panel and product barrier together form a product pocket for receiving a product, and the pocket panel holds the product against the product barrier. The elongated parallel inflatable tubes forming the product barrier have pillar tube extensions that extend from first and second ends of the product barrier and are adapted to bend upwardly with respect to the product pocket at a hinge line, each pillar tube extension acting as a pillar and the pillar tube extensions together thereby forming bulkhead end walls respectively positioned at the first and second ends of the product pocket and any product positioned therein. The inflatable tubes are preferably inflated before the product is placed in the product pocket.

In an aspect of the invention, distal flap tube extensions further extend from the pillar tubes and form distal flaps that are adapted to fold inwardly over the product pocket and a product received therein, opposite the product barrier.

In another aspect of the invention, the first and second side edges of the product panel are respectively secured between the side spacers and the next adjacent inflatable tubes.

In a further aspect of the invention, the inflatable product barrier tubes and the extension thereof each have an inflation valve and are inflated from a plenum extending across an end of the inflatable packaging cushion. This permits multiple inflatable packaging cushions to be connected at tear off seams and provided in rolls, and also adapts the inflatable packaging cushion to be inflated by automated equipment.

The inflatable packaging cushion receives a product in the product pocket. The inflatable packaging cushion, with the inflatable tubes in their inflated condition, the product therein, and the bulkhead end walls folded inwardly is placed in a carton having a width that closely receives the product barrier and its side spacers. The distal flaps, if included, are folded to positions adjacent the product pocket and product. The carton has a length which accommodates the length of the product platform and the inwardly folded bulkhead end walls. The carton has a depth that closely accommodates the height of the bulkhead end walls. The carton has a top that is closed once the inflatable packaging cushion and product are placed in the carton.

In the preferred orientation, the product barrier spaces and cushions the product with respect to the top wall of the carton, and the side spacers prevent the product from contacting the side walls of the carton. The product barrier and the bulkhead end walls protect and cushion the product with respect to the end walls of the carton, and the bulkhead end walls maintain the product in spaced relation with respect to the bottom wall of the carton. The distal flaps cushion the product if the product pocket is distorted. Thus, the product is cushioned and spaced from the carton and is cushioned and protected in the event the carton is dropped or impacted. The inflatable packaging cushion and product may also be inserted in the carton with the product barrier adjacent the bottom wall of the carton.

Other and more specific objects and features of the invention will appear in the following detailed description of the invention and the claims, taken together with the drawings.

BRIEF DESCRIPTION OF THE DRAWINGS

The same reference numerals refer to the same elements throughout the various figures.

DETAILED DESCRIPTION OF THE INVENTION

Figure 1:
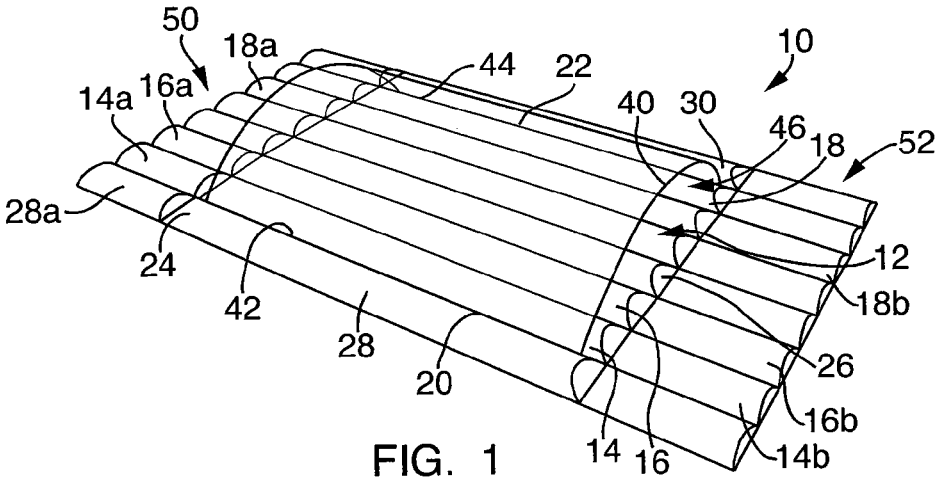
FIG. 1 is a schematic perspective view of an inflatable packaging cushion according to the invention herein.

With reference to FIG. 1, an inflatable packaging cushion 10 according to the invention herein is schematically illustrated. It is shown in its preferred orientation for inserting a product therein. Provision for inflation is omitted from FIG. 1 and some other Figures for ease of illustration, but is described below with reference to FIG. 2.

The inflatable packaging cushion 10 formed of a plurality of adjacent elongated parallel connected inflatable tubes. The central portions of the inflatable tubes are barrier tubes 14, 16, 18, etc. form a product barrier 12 having first and second sides 20 and 22, and first and second ends 24 and 26. An additional elongated parallel tube is connected to tube 14 and forms a side spacer 28 of the product barrier 12 along the first side 20. Another elongated parallel tube is connected to the elongated tube 18 of the product barrier 12 and forms a side spacer 30 of the product barrier 12 along the second side 22.

A pocket panel 40 has a first side edge 42 connected at or along the elongated tube 14 adjacent the first side 20 of the product barrier 12, and the pocket panel 40 has a second side edge 42 connected at or along the elongated tube 18 adjacent the second side 22 of the product barrier 12. The pocket panel 40 extends across the product barrier 12 and the product barrier 12 and the pocket panel 40 together form a product pocket 46 therebetween.

The elongated parallel inflatable barrier tubes 14, 16 and 18, etc. and the elongated parallel tubes forming the side spacers 28, 30 forming the product barrier 12 have pillar tube extensions 14*a*, 16*a*, 18*a* etc. respectively extending from the first end 24 of the product barrier 12, each tube acting as a support pillar and the tubes together forming an end wall bulkhead 50. Similarly, the barrier tubes 14, 16, 18 etc. and the side spacers 28 and 30 have pillar tube extensions 14*b*, 16*b*, 18*b* respectively extending from the second end 26 of the product barrier 12, each tube acting as a pillar and the tubes together forming a second end wall bulkhead 52.

As more fully discussed below with reference to FIGS. 4-11, a product 1 is inserted in the product pocket 46, the end wall bulkheads 50 and 52 are folded upwardly with respect to the product 1 and the inflatable packaging cushion 10 and the product placed in a carton 90, thereby protecting the product 1 during shipment. This will be more fully understood with reference to the construction of the inflatable package cushion 10 shown in FIGS. 2 and 3.

Figure 2:
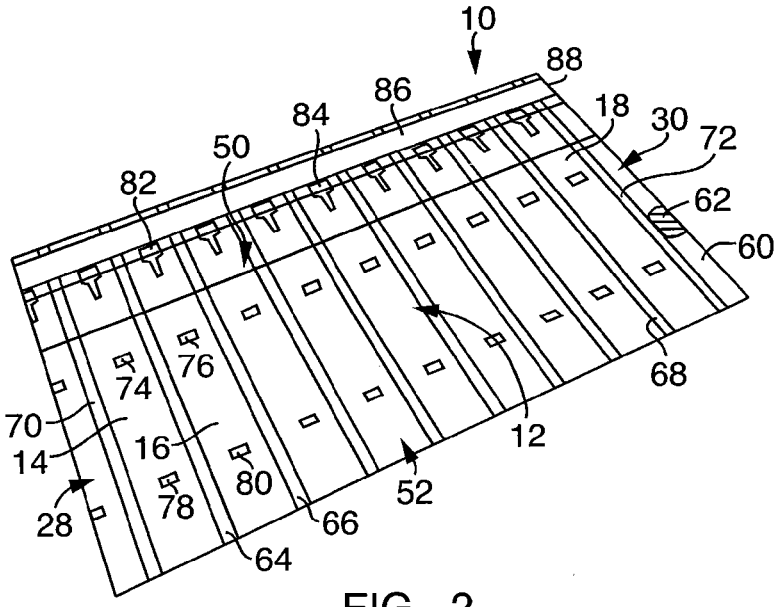
FIG. 2 is a perspective view of a partially assembled inflatable packaging cushion of FIG. 1.

With reference to FIG. 2, the inflatable packaging cushion 10 is fabricated of two sheets of thermoplastic material 60 and 62 that are juxtaposed and have a pattern of heat sealed seams connecting them. The thermoplastic sheets 60 and 62 may be a single sheet folded over to provide the juxtaposed positioning of the two sheets 60, 62. The material may be LD polyethylene or a nylonpolyethylene co-extrusion or lamination.

The barrier tubes 14, 16, 18, etc. forming the product barrier 12 are formed by seam lines 64, 66, 68, etc. and the seam lines also form the pillar extensions of the inflatable tubes that form the pillars of the end wall bulkheads 50 and 52. The product barrier 12 is formed between seam 70, which also forms the side 20 of the product barrier 12, and the seam 72 which also forms the second side 22 of the product barrier. The first and second side edges of the pocket panel may be connected at the side edges 20, 24 of the product barrier, or may be connected between more inwardly positioned inflatable tubes.

Spot seams 74, 76 etc. form the first end 24 of the product barrier as well as a fold line for the first end bulkhead 50. Similarly, spot seams 78 and 80 form the second end 26 of the product barrier and provide for folding of the second end wall bulkhead 52.

The adjacent elongated parallel tubes 14, 16, 18, etc. and the pillar tube extensions and the side spacers 28, 30 have individual inflation valves 82, 84 etc. mounted at the terminals of the pillar extenious forming the bulkhead wall 50, and a plenum 86 provides for inflating the tubes through the individual valves.

Inflation air is introduced into plenum 86 at opening 88 positioned on the side edge of the inflatable packaging cushion 10. An inflation probe may be inserted for this purpose.

Alternatively, a plurality of inflatable packaging cushion 10 may be provided in a roll with the plenum sheets connected to the end of the next adjacent cushion 10 by a perforated tear line. Automated inflation apparatus of the type now in use in the art can then be employed to fill the inflatable packaging cushion 10.

Each elongated inflatable tube is individually inflated through is respective valve 82 and therefore a rupture or leak in any one tube does not comprise the overall integrity of the inflatable packaging cushion 10. It is preferable that the plenum itself is sealed after inflation, thereby providing a secondary seal against possible leakage of the valves 84.

Depending on the inflation facilities available at the point of use, inflatable tubes may be inflated at the time of manufacture of the inflatable packaging cushion 10, in which case a permanent seal of the plenum can be provided, or may be shipped flat prior to use, the product panel 40 being flexible. It may be shipped with a complementary carton, also folded flat. This is especially advantages when it is necessary to provide a shipping container for returning products. In the flat configuration, the tubes do not take a substantial amount of space. However, if inflation facilities are available at the point of use, it is desirable to ship the inflatable packaging cushion 10 uninflated either in stacks or on rolls, in which case it occupies a very small volume during shipping and storage. For instance, 5,000-20,000 uninflated packaging cushions on a single standard pallet can replace 3-6 truckloads of expanded cushioning products, such as polyethylene and polymethane foams, polystyreme shapes, and inflated bubble sheets.

Figure 3:
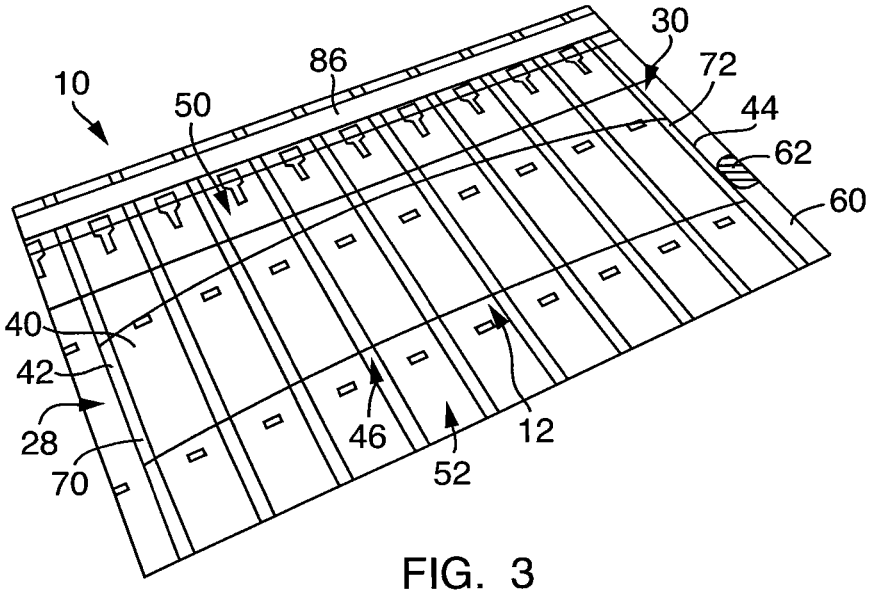
FIG. 3 is another perspective view of the inflatable packaging cushion of FIG. 1, in its uninflated condition.

With reference to FIG. 3, the pocket panel 40 has its first and second side edges 42, 44 respectively joined with the thermoplastic sheets 60, 62 at seams 70 and 72, those seams also forming the side spacers 28 and 30. The size of the pocket panel 40 is selected to accommodate a desired product 1, and hold it against the product barrier 12, but may be sized to accommodate products within a reasonable range of dimensions if the inflatable packaging cushion 10 is provided for general use. In addition, the size of the inflatable tubes, the dimensions of the product barrier 12 and the end wall bulkheads 50, 52 may be selected as desired, with reference to the size of the carton 90 in which the inflatable packaging cushion 10 is to be used and the degree of cushioning that is desired.

Figure 4:
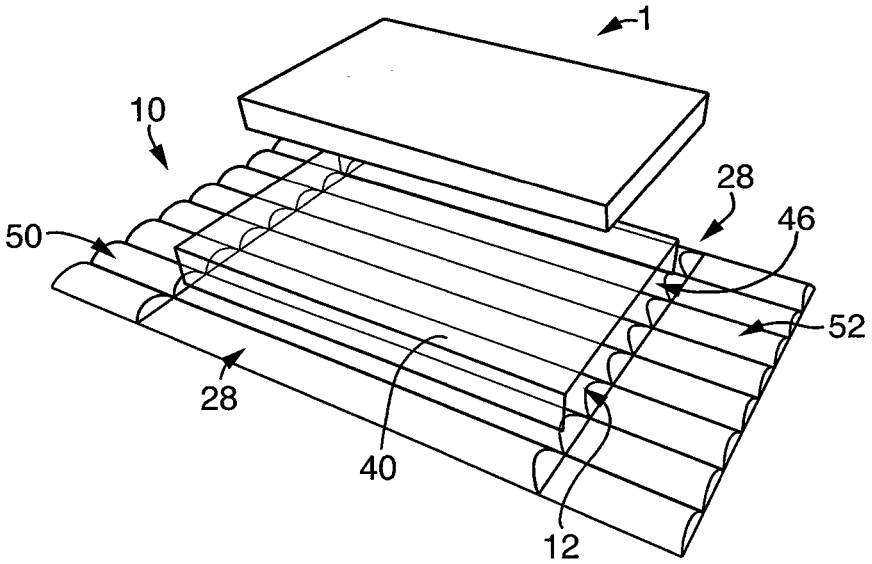
FIG. 4 is a schematic view of an inflatable packaging cushion of FIG. 1, shown inflated and with a product adjacent thereto.
Figure 5:
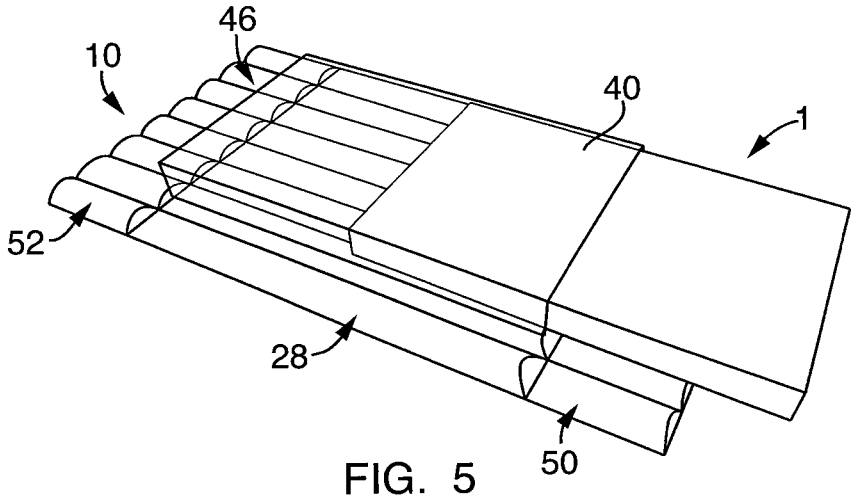
FIG. 5 is a schematic perspective view of the inflatable packaging cushion and product of FIGS. 4, showing the product being inserted into a product pocket thereof.
Figure 6:
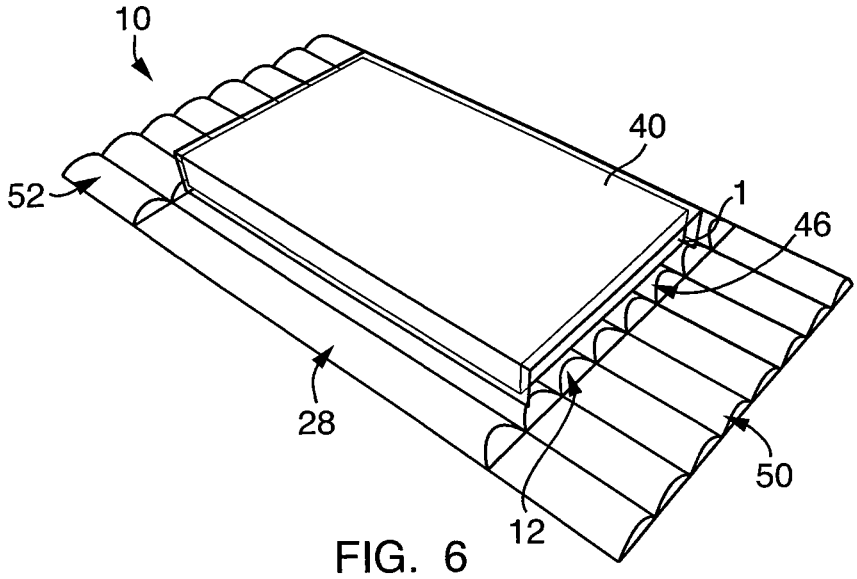
FIG. 6 is a schematic perspective view of the inflatable packaging cushion and product of FIGS. 4, showing the product fully inserted in the product pocket.

With reference to FIG. 4, the inflatable packaging cushion 10 is shown positioned for receiving a product 1. For simplicity of illustration, the plenum 86 and valves 82. The pocket panel 40 is shown extended upwardly from the product barrier 12 to form the product pocket 46, and it will be understood that this is schematically shown and actually accomplished by manipulation when placing the product 1 in the product pocket 46. With reference to FIG. 5, the product 1 is shown partially inserted in the product pocket 46, and in FIG. 6, the product 1 is shown fully inserted in the product pocket 46. When the product 1 is fully inserted in the product pocket 46 as shown in FIG. 6, the product is held snuggly against the product barrier 12.

Figure 7:
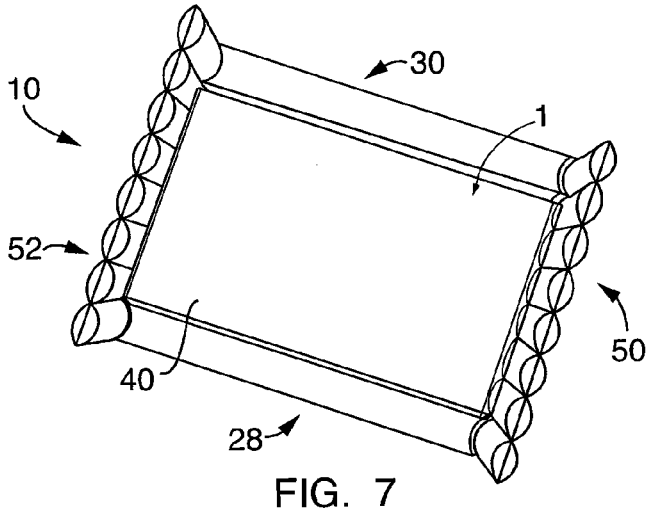
FIG. 7 is an inverted perspective of the inflatable packaging cushion and product of FIGS. 6, with bulkhead end walls folded inwardly with respect to the product.
Figure 8:
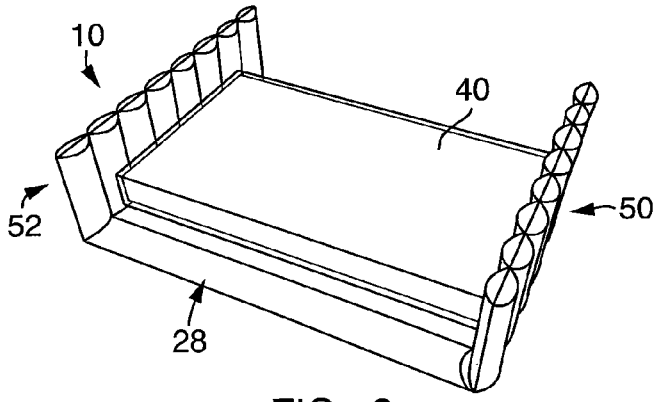
FIG. 8 is another inverted schematic inverted perspective view of the inflatable packaging cushion and product of FIG. 6 with the bulkhead walls folded inwardly with respect to the product.

With reference to FIGS. 7 and 8, the end wall bulkheads 50 and 52 are shown folded upwardly with respect to the product pocket 46 and the product 1 contained therein. This holds the product 1 in the product pocket 46 and cushions the ends of the product 1. As best seen in FIG. 8, the end wall bulkheads 50 and 52 when folded inwardly extend beyond the product 1. The side spacers 28, 30 also extend laterally from product 1.

Figure 9:
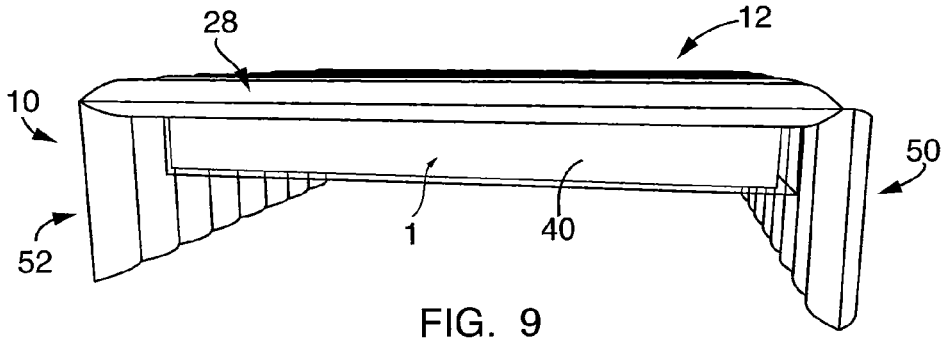
FIG. 9 is a perspective view of the inflatable packaging cushion and product of FIG. 6, shown in the preferred position for insertion in a carton.
Figure 10:
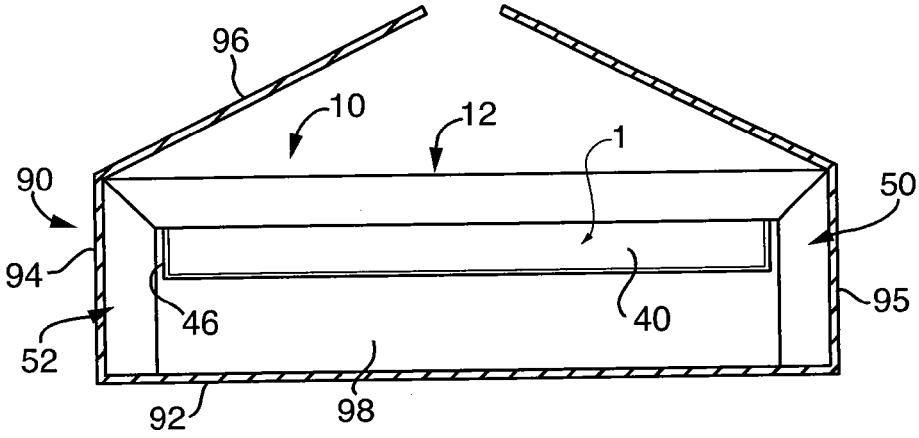
FIG. 10 is a sectional view of the inflatable packaging cushion and product of FIG. 9, shown inserted in a carton.
Figure 11:
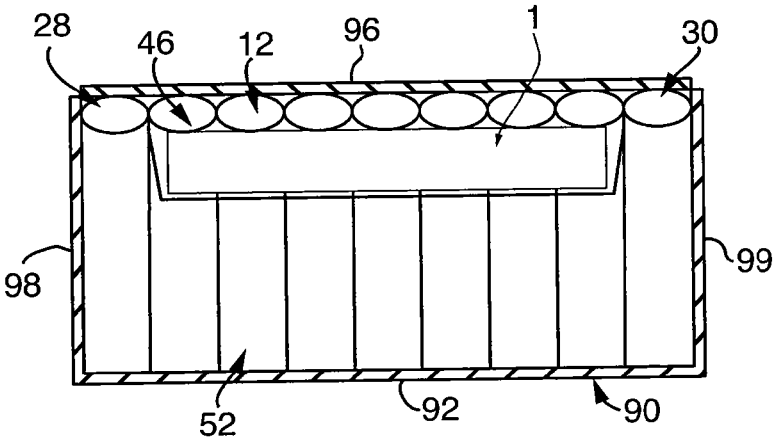
FIG. 11 is another sectional view of the inflatable packaging cushion and product of FIG. 9, shown inserted into a carton.

The orientation of the inflatable packaging cushion 10 shown in FIGS. 5-8 is the orientation in which it is most convenient to insert the product 1 into the product pocket 46. However, as shown in FIG. 9-11, it is preferred that the inflatable packaging cushion 10 be utilized with the product barrier 12 disposed above the product 1, with the end wall bulkheads 50, 52 extending below the product 1. This suspends the product 1 and provides the benefit of additional isolation of the product 1 from vibration. However, this is a matter of choice and the inflatable packaging cushion 10 can be used in any desired orientation, and it is further understood that packages are often not maintained in the intended orientation during shipment.

With reference to FIGS. 10 and 11, the inflatable packaging cushion 10 with the product 1 therein is inserted in a carton 90. With particular reference to FIG. 10, the end wall bulkheads 50 and 52 support the product 1 above the bottom wall 92 of the carton 90, and also provide cushioning between the product and the end walls 94 and 95 of the carton 90. The product barrier 12 provides spacing and cushioning between the product 1 and the top wall 96 of the carton 100.

With particular reference to FIG. 11, the spacings and cushionings of the product 1 described above are also illustrated, together with the function of the side spacers 28 and 30. They separate the product pocket 46 and the product 1 therein from the side walls 98, 99 of the carton 90.

Figure 12:
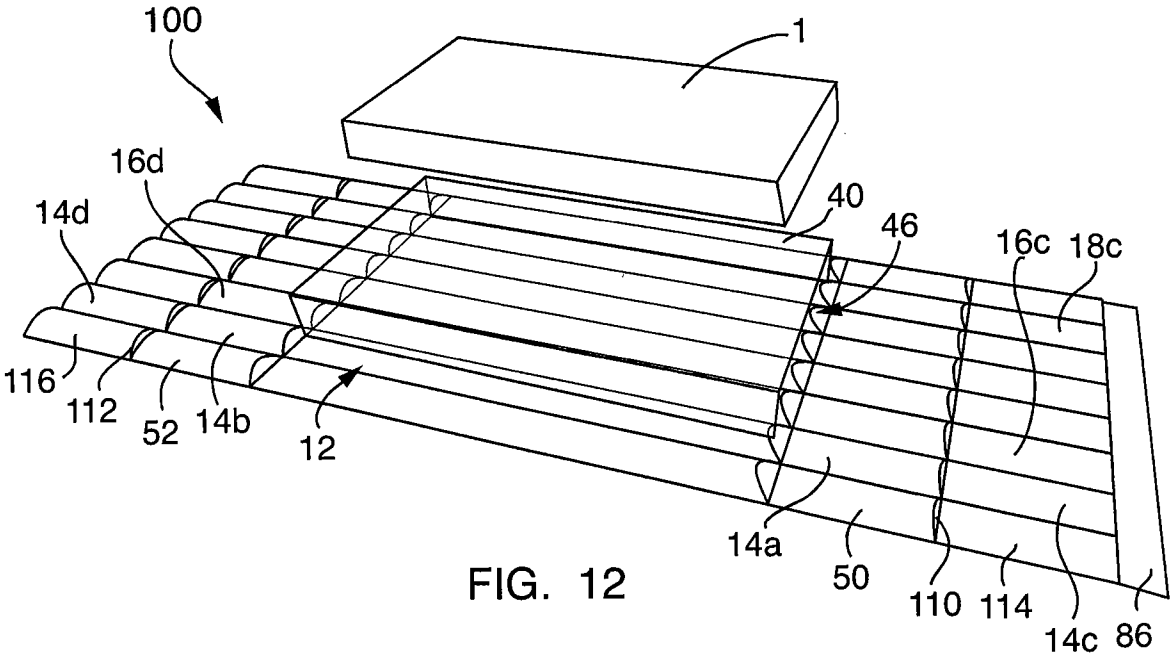
FIG. 12 is a schematic perspective view of another inflatable packaging cushion according to the invention herein and a package to be cushioned thereby.
Figure 13:
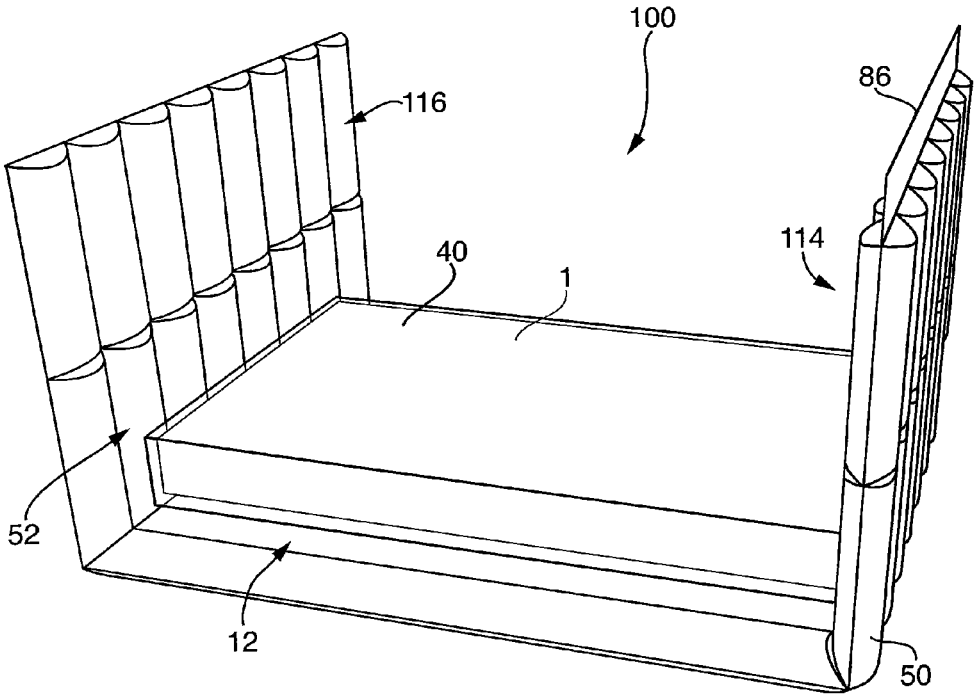
FIG. 13 is a perspective view of the inflatable packaging cushion of FIG. 12 with the product inserted therein and partially folded toward an operative position.
Figure 14:
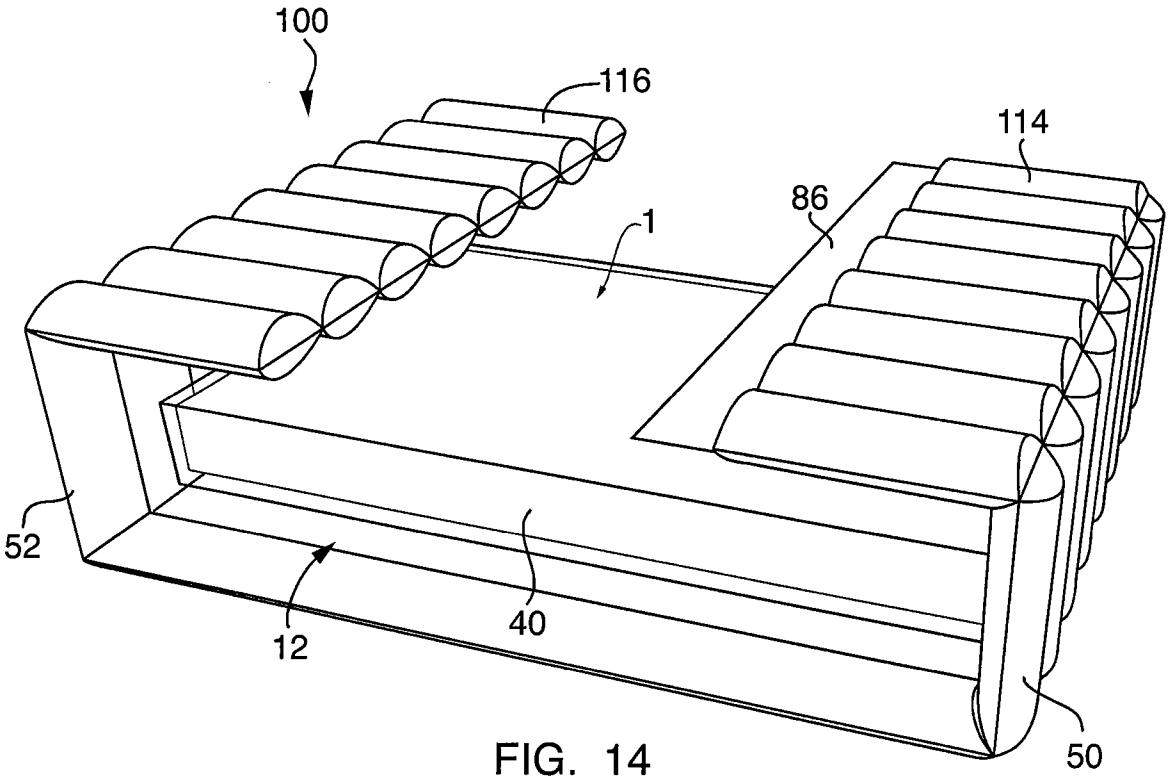
FIG. 14 is a perspective view of the inflatable packaging cushion of FIG. 12 with a product inserted therein, shown folded to its operative position.

With reference to FIGS. 12-14, another inflatable packaging cushion 100 according to the invention herein is illustrated. It is similar to the inflatable packaging cushion 10 described above, and is characterized by the elongated parallel connected inflation tubes 14, 16, 18 etc. having additional distal flap extensions 14*c*, 16*c*, 18*c* etc. and 14*d*, 16*d* and 18*d* etc. that extend from the filler tubes at fold lines 110 and 112 to form distal flaps 114, 116.

The inflation plenum and inflation valves are positioned at the terminus of the distal 110, and the fold lines that are created by spot seams permit inflation air to flow through the inflation tubes.

With reference to FIG. 12, a product 1 is positioned above the product barrier 12 and pocket panel 40. The bulkhead and end walls and opposite product barriers extend generally flat from the product barrier 12, to facilitate inserting the product 1 into the product pocket 46.

With reference to FIG. 2, the product 1 has been inserted and the bulkhead end walls folded upwardly, similar to the process and orientation described above with respect to the inflatable packaging cushion 10.

With reference to FIG. 13, the distal flaps 114, 116 have been folded inwardly to extend over the product pocket 46 and product 1 therein, opposite the product barrier 12. It is preferable that the end wall bulkheads extend past the product pocket 46 and product 1 inserted therein, so that the inflatable packaging cushion 100 still operates to suspend the product 1 when used in the preferred orientation that is reversed from the orientation shown in FIG. 13. The orientation shown in FIG. 13 is convenient for inserting the inflatable packaging cushion 100 and product 1 into a carton, after which it is preferably inverted.

The distal flaps 114 and 116 provide a fail safe mode in the event the package suffers an extreme load that temporarily collapses or distorts the bulkhead end walls or deforms the product barrier 12.

The basic configuration and structure of the inflatable packaging cushions 10, 100 permit them it to be adapted to a wide variety of products and cartons, by simply selecting the dimensions of the tubes forming the inflatable packing cushion 10, 100 and the product panel 40 forming the product pocket 46 thereof. For instance, for small products, the product panel 40 can more closely match the width of the product barrier 12, forming a smaller thinner product pocket 46 that more closely holds a smaller product. However, it should also be noted that small products can be accommodated in a larger product pocket, because the product pocket itself is separated from the carton. Similarly, the height of the end wall bulkheads 50, 52 can be greater in combination with a larger product panel 40 to accommodate larger products or to provide additional cushioning spacing and cushioning for heavier products. The dimensions and inflation pressures of the tubes can also be adjusted to provide the desired cushioning accommodating various product densities.

It will therefore be understood that the foregoing descriptions of the inflatable packaging cushion 10, 100 are directed to a preferred embodiment thereof, and various modifications may be made by those skilled in the art without departing from the spirit and scope of the invention.

The invention claimed is:

1. An inflatable packaging cushion comprising thermoplastic sheet material connected by seams and spot seams in a configuration having:

A) a product barrier formed by a plurality of adjacent elongated parallel connected inflatable product barrier tubes, the product barrier having first and second sides and first and second ends;

B) a pocket panel having first and second sides respectively secured along the first and second sides of the product barrier and extending thereacross, the product barrier and pocket panel together forming a product pocket for receiving a product;

C) pillar tube extensions of the product barrier tubes forming first and second bulkhead end walls respectively extending from the first and second ends of the product barrier, the bulkhead end walls foldable to extend upwardly from the product barrier and extending beyond the product pocket and a product received therein when so folded;

D) a first inflatable tube positioned adjacent and connected to the product barrier tube at the first side of the product barrier and a second inflatable tube positioned adjacent and connected to the product barrier tube at the second side of the product barrier to form first and second side spacers of the inflatable packaging cushion, the first side of the pocket panel connected to the first side of the product barrier adjacent the first side spacer and the second side of the pocket panel connected to the second side of the product barrier adjacent the second side spacer;

whereby the inflatable packaging cushion is adapted for insertion into a carton for cushioning a product therein, including suspending the product with respect to a carton wall opposite the product barrier and product pocket.

2. An inflatable packaging cushion as defined in claim 1 and further comprising:

D) distal flap tube extensions extending from the pillar tube extensions forming the bulkhead end walls, the distal flap tube extensions forming first and second distal flaps respectively extending from the first and second bulkhead end walls, the first and second distal flaps foldable to extend generally opposite the product barrier, product pocket and a product contained therein, the bulkhead walls extending sufficiently beyond the product pocket and product contained therein to suspend the product with respect to the second distal flaps.

3. An inflatable packaging cushion as defined in claim 2 and further comprising:

E) a plurality of individual inflation valves respectively mounted at the ends of the inflatable tubes, including any tube extensions thereof, for admitting inflation air into each individual inflatable tube; and F) a plenum extending across the inflatable packaging cushion for supplying inflation air to the individual inflation valves.

4. An inflatable packaging cushion as defined in claim 3 wherein the plenum is accessed through an opening on a side of the inflatable packaging cushion.

5. An inflatable packaging cushion as defined in claim 1 and further comprising:

I) a plurality of individual inflation valves respectively mounted at the ends of the inflatable tubes, including any tube extensions thereof, for admitting inflation air into each individual inflatable tube; and J) a plenum extending across the inflatable packaging cushion for supplying inflation air to the individual inflation valves.

6. An inflatable packaging cushion as defined in claim 1 wherein the plenum is accessed through an opening on a side of the inflatable packaging cushion.

7. An inflatable packaging cushion as defined in claim 6 wherein a plurality of such inflatable packaging cushions are separated by perforated tear lines at or adjacent to the plenum.

8. An inflatable packaging cushion as defined in claim 7 wherein the plurality of such inflatable packaging cushions are provided as a roll.

* * * * *